US005114774A

United States Patent [19]

Maxim, Jr.

[11] Patent Number: 5,114,774

[45] Date of Patent: May 19, 1992

[54] ABSORBENT FLOOR MAT

[75] Inventor: Henry A. Maxim, Jr., Salem, Ohio

[73] Assignee: Maxim Sorbents, Inc., Salem, Ohio

[21] Appl. No.: 485,218

[22] Filed: Feb. 26, 1990

Related U.S. Application Data

[63] Continuation-in-part of Ser. No. 245,827, Sep. 16, 1988, abandoned.

[51] Int. Cl.[5] ..... B32B 3/06; B32B 3/02; B32B 33/00; B05D 1/14

[52] U.S. Cl. ..... 428/101; 428/88; 428/90; 428/92; 428/100; 428/190

[58] Field of Search ..... 428/101, 100, 85, 86, 428/90, 92, 88

[56] References Cited

U.S. PATENT DOCUMENTS

| | | | |
|---|---|---|---|
| 2,810,671 | 10/1957 | Taylor | 428/101 X |
| 4,328,275 | 5/1982 | Vargo | 428/156 |
| 4,361,925 | 12/1982 | Yamamoto et al. | 428/100 X |
| 4,421,809 | 12/1983 | Bish et al. | 428/90 |
| 4,717,611 | 1/1988 | Petrella et al. | 428/100 X |
| 4,755,401 | 7/1988 | Friedrich et al. | 428/100 X |
| 4,802,939 | 2/1989 | Billarant et al. | 428/100 X |
| 4,829,627 | 5/1989 | Altus et al. | 428/85 X |
| 4,968,548 | 11/1990 | Gibson et al. | 428/100 X |

*Primary Examiner*—George F. Lesmes
*Assistant Examiner*—Terrel Morris
*Attorney, Agent, or Firm*—Reed Smith Shaw & McClay

[57] ABSTRACT

A floor mat system is disclosed wherein the floor mat is removably attachable to an existing floor, and enables the use of the floor by pedestrians in wet and oily environments. The mat includes a skid-free upper surface bounded by an edging portion either or both of which has self-gripping fastener means attached thereto and a removable portion which is capable of absorbing liquids such as water or oil coming in contact therewith. The removable portion is adapted to be removably attached to the fastener means to provide for removal and cleaning of the removable portion and is positioned below the skid-free upper surface and edging portion.

8 Claims, 5 Drawing Sheets

ABSORBENT FLOOR MAT

This is a continuation-in-part of U.S. patent application Ser. No. 07/245,827 filed Sept. 16, 1988, now abandoned.

FIELD OF THE INVENTION

The present invention relates to flooring materials, specifically those used in wet and oily environments.

BACKGROUND OF THE INVENTION

For as long as people have walked on floors, there has been a problem of preventing people from slipping and falling on those floors. The problem is particularly pronounced when the floors are in industrial, restaurant, garages and/or public areas. In such areas, water, oil, grease, food, or other liquid or moist materials are frequently deposited or spilled onto the floor surface, presenting a significant hazard to pedestrians and generally unclean conditions. Efforts to keep such surfaces clean and dry are often futile, as the instances and/or quantities of spillage are too great.

In industry in particular, efforts to overcome the above problem have included throwing mats or other temporary surfaces on the permanent base floor, with varying success. Ultimately, such temporary mats themselves become saturated with water or oily materials and thus agitate rather than prevent the hazardous and unclean situation. Saturated mats also had to be cleaned or replaced at considerable cost. Furthermore, such mats are not generally self-adhering to the base floor, and thus are subject to being inadvertently pushed and sliding out of position.

Various means to solve the above problems, including those shown in U.S. Pat. No. 4,644,592, have been of limited success. While such mats claim to be removably securable to a base floor, such mats are water repellant rather than absorbent, and are generally intended for disposable use, rather than being reusable.

Therefore, it would be beneficial to provide a floor mat which is reusable, and removably positionable on an existing floor. It would be further beneficial if such floor mat would be able to absorb liquids such as water, oil, and food, and provide a relatively skid-free surface for pedestrian traffic.

SUMMARY OF THE INVENTION

The present invention addresses problems of prior floor mat systems by providing a floor mat which is removably attachable to a base floor in a wet or oily environment. One preferred embodiment of the floor mat includes a base portion having a self-gripping fastener means, which base portion is laid atop the existing floor. This embodiment of the invention further includes a fiber-containing removable portion which is positioned above the base portion. The removable portion has an upper surface that is absorbent and/or adsorbent of water and oily materials and is adapted to reduce the incidence of pedestrian slipping or skidding in wet or oily environments. The fiber-containing removable portion further has a lower surface which is adapted to enable the fiber-containing removable portion to be removably attached to the self-gripping fasteners of the base portion.

In a preferred embodiment of the invention the floor mat removable portion is constructed of a fiber containing material such as indoor-outdoor carpeting. Also in a preferred embodiment of the invention, the base portion is constructed of a malleable plastic-like material which can be rolled and unrolled easily. This material may either be a firm type of rubber, rubberlike material or plastic or a sponge-like material, such as polyethylene foam having a plastic or rubber coating. In yet another preferred embodiment of the invention the self-gripping fastener means are VELCRO®, and the lower surface of the removable portion is sufficiently rough to permit the removable attachment of the removable portion to the VELCRO® fastener means. In still a further preferred embodiment of the invention, the self-gripping fastener means are arranged atop a spacer means such that a drainage space exists between the removable portion and the base portion, which drainage space allows liquid to drain through the removable portion rather than lie therein.

In another preferred embodiment of the invention a skid-free upper surface is attached to an edging portion which bounds the skid-free surface. A fiber-containing removable portion acts as a subsurface and is removably attached beneath the skid-free surface permitting the resulting mat to be absorbent.

Other details, objects and advantages of the invention will become apparent as the following description of the presently preferred embodiments and presently preferred methods of practicing the invention proceeds.

BRIEF DESCRIPTION OF THE DRAWINGS

In the accompanying drawings, the preferred embodiments of the invention and preferred methods of practicing the invention are illustrated in which.

DETAILED DESCRIPTION OF THE INVENTION

Figure 1:
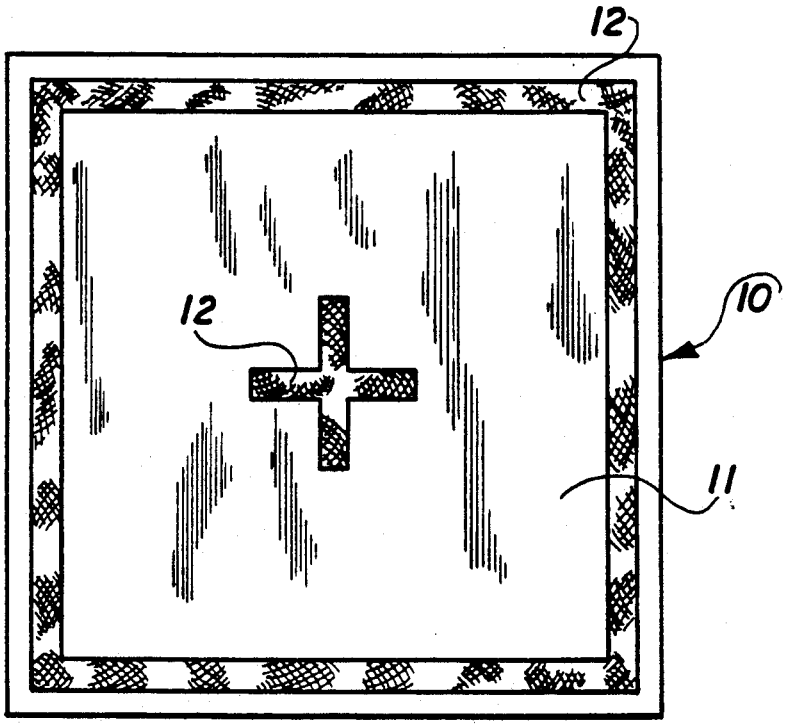
FIG. 1 shows an overhead plan view of a floor system using a preferred embodiment of the present invention.
Figure 2:
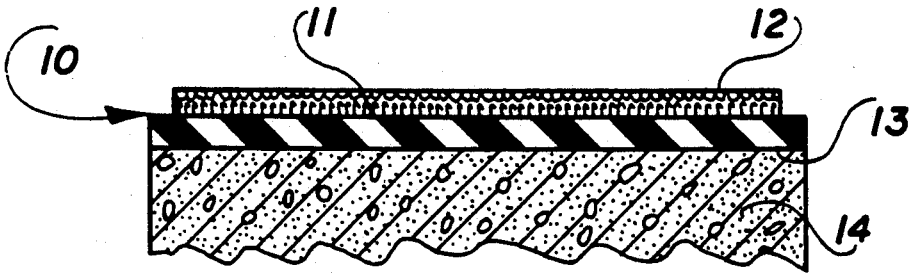
FIG. 2 shows a side cross-sectional view of a floor system using a preferred embodiment of the present invention.

FIG. 1 illustrates a plan view of the base portion generally 10 of a preferred embodiment of the present invention. As illustrated, the base portion 10 has a substantially planar upper surface 11, to which is attached a plurality of self-gripping fastener means 12. These self-gripping fastener means 12, are preferably hook and loop type fasteners, for example, VELCRO®, or equivalents thereto, such as that manufactured by APLIX, 12300 Steele Creek Road, Box 7505, Charlotte, North Carolina 28217. As illustrated in FIG. 2, the base portion 10 has a bottom surface 13, which rests on the existing floor structure 14. The base portion 10 may either be permanently secured to the floor, for example with an adhesive means, or may be removably secured to the floor, for example with double-sided tape, or other non-permanent means, or may simply be laid atop the existing floor. In the later case, the bottom surface 13 of the base portion is preferably provided with a skid resistance surface, such as tread or ribs, known to those skilled in the art.

The floor mat of the present invention is ideally suited for use in so-called wet or oily environments, wherein heavy traffic combines with the presence of water, oil, grease, spilled food, or other liquid or semi-liquid substances, thereby creating a serious hazard to pedestrians.

Figure 3:
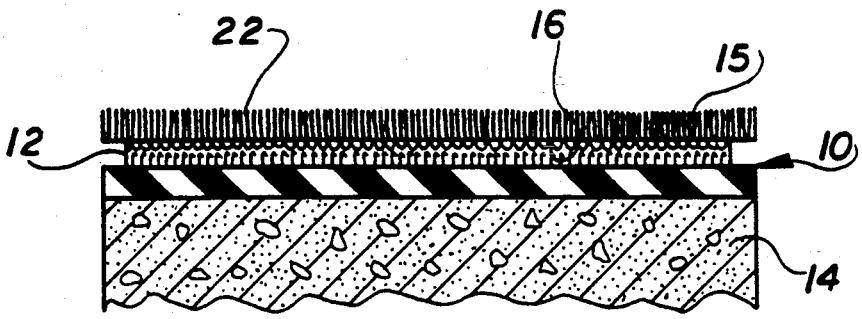
FIG. 3 shows a side cross-sectional view of a floor system using a preferred embodiment of the present invention with the fabric containing upper surface position thereon.

FIG. 3 illustrates a preferred embodiment of the present invention in a cross-sectional elevation view. As illustrated, the base portion 10 rests beneath a fiber-containing removable portion 15. The fiber-containing removable portion 15, in turn rests on the self-gripping fastener means 12. The removable portion 15 is preferably an absorbent and/or adsorbent material adapted for absorbing watery and oily liquids and semi-liquids and has an upper surface adapted to reduce the incidence of pedestrian slippage or skidding on a floor covered with the mat in a wet or oily environment, relative to floor surfaces in similar environments which are not equipped with the mat.

The removable portion 15 may be constructed of an olefin such as indoor-outdoor carpeting or may be constructed of any other suitable fiber-containing floor covering materials capable of absorbing and/or adsorbing liquids and semi-liquids, such as through capillary attraction of oil molecules to the fibers, and most desirably is a nonwoven material composed of polypropylene fibers. The removable portion 15 may comprise a fabric "diaper," fabricated, for example, of needle-punched polypropylene. Most preferably, the removable portion 15 is constructed of short fiber polypropylene fibers having a fineness of 4–6 Denier. Preferably, the fibers are mechanically interlocked by needle punching and heat bonding. Preferably, the removable portion 15 has an upper surface 22 which is fused for better abrasion resistance and greater tear strength.

The removable portion 15 has a lower surface 16 which is adapted to enable the removable portion 15 to be removably attached to the self-gripping fasteners 12. This is achieved by providing the lower surface 16 with a roughened texture, or fiber backing, which permits removable attachment of the lower surface 16 to the self-gripping fasteners 12, which, as stated earlier, are preferably VELCRO®. The lower surface 16 may be provided by a separate backing layer, or more preferably comprises the same material used for the upper portion 15, such as fibrous polypropylene.

The removable portion may be disposable, but preferably is constructed of a durable material that permits repeated use and washing. To clean the removable portion, the removable portion is simply removed from the base portion 10, and hosed off with a cold water rinse. Hot water is preferably not used, nor is machine washing recommended, due to possible resulting crinkling and shrinkage. After washing, the removable portion is dried, either by drip-drying or wringing. Preferably, heated dryers are not used. Alternatively, the removable portion may be dry-cleaned using conventional dry cleaning methods.

The base portion 10 preferably comprises a malleable rubberlike or plastic-like material. Such materials include, but are not necessarily limited to, polyvinyl chloride ("vinyl"), natural rubber, synthetic rubber, polyethylene, polyurethane, acrylonitrile, or other similar known materials. Alternatively, the base portion 10 may comprise a sponge-like material, such as foam rubber, or polyethylene foam, or other known equivalents thereof. Such materials provide a cushioned effect for the floor mat.

Figure 4:
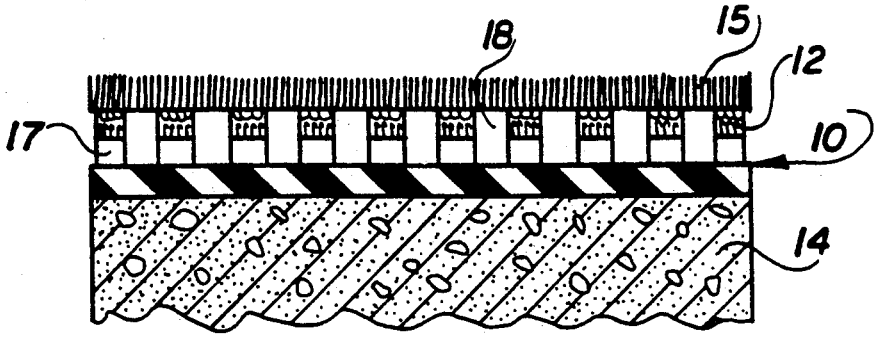
FIG. 4 shows a side cross-sectional view of a floor system using yet another preferred embodiment of the present invention showing the drainage space between the removable portion and the base portion.

Yet another preferred embodiment of the invention is illustrated in FIG. 4. As shown, the base portion 10 in this embodiment includes an array of spacer means 17 or "nibs", which assist in raising the removable portion 15 relative to the base portion 10, creating a drainage space 18 therebetween. The spacer means 17 may be integrally formed with the base portion 10 or may be applied thereto at a later time. Each spacer means 17 preferably has a self-gripping fastener means attached thereto as illustrated, although this is not absolutely necessary. The spacer means 17 may be positioned in an array on the upper surface of the base portion 10, creating channels therein, for the retention of liquid, which drains through the removable portion 15. In this way, the removable portion 15 is prevented from sitting in the liquid which is spilled thereon. In an alternative embodiment of the invention, the nibs 17 may be replaced with an embossed pattern.

Figure 5:
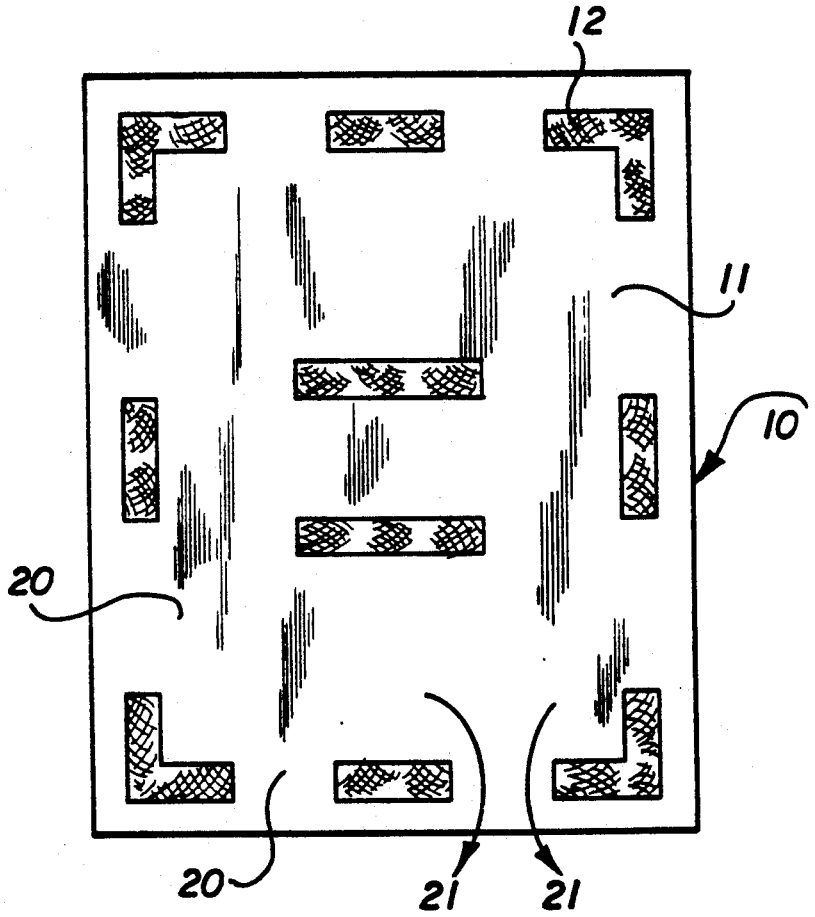
FIG. 5 shows an overhead plan view of the base portion of a preferred embodiment of the present invention, illustrating placement of self-gripping fastener means.

Yet another preferred embodiment of the invention is illustrated in FIG. 5. As shown, the self-gripping fasteners 12 may be arranged in pieces, such that spaces 20 are provided between the pieces of self-gripping fasteners 12. Water or other saturating fluid may pass through these spaces 20 as illustrated by the arrows 21.

The floor mat of the present invention significantly improves the floor surface in a wet environment. Liquids are absorbed or adsorbed or drained through the removable portion 15 and thus significantly reduce the likelihood of slipping which is present when such liquids merely lie on a nonabsorbent surface. Once the removable portion 15 has become saturated with liquid, the detachable nature of the invention permits the saturated removable portion to be removed and replaced with a new dry removable portion 15. In the meantime, the saturated removable portion may be dried or cleaned for reuse as earlier indicated, or simply disposed. The mats of the present invention are preferably cut to appropriate widths and lengths to provide for ease of application.

Figure 6:
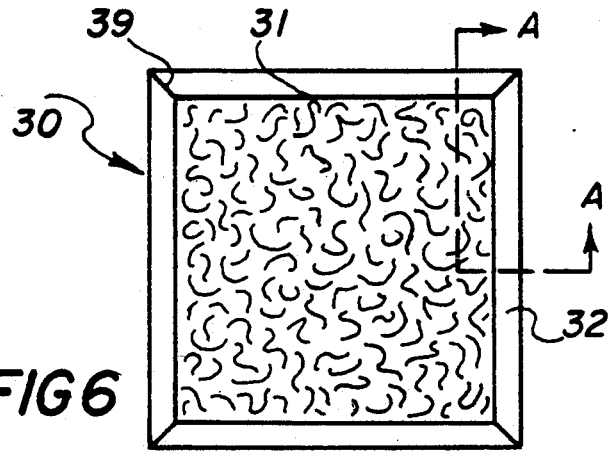
FIG. 6 shows an overhead plan view of another preferred embodiment of the present invention, having a skid-free upper surface bounded by an edging portion.
Figure 7:
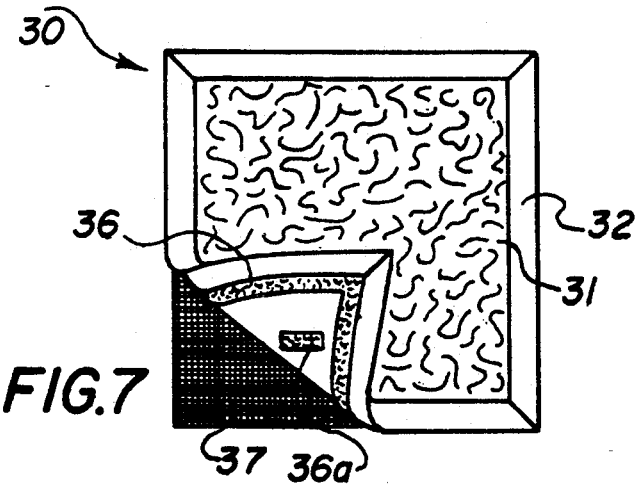
FIG. 7 shows a portion of the skid-free upper surface of FIG. 6 lifted up to reveal the fiber-containing removable portion below.
Figure 8:
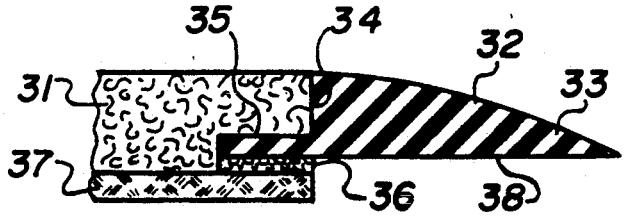
FIG. 8 shows a cross section along lines A—A of FIG. 6.

Another preferred embodiment of the present invention is illustrated in FIGS. 6, 7 and 8. FIG. 6 illustrates a floor mat 30 having a skid-free perforated or porous upper surface portion 31 bounded by an edging portion 32. Although the embodiment illustrated in FIGS. 6 and 7 details the edging portion 32 circumventing the entire periphery of the upper surface 31, this is not necessarily required. For example, particularly long mats, such as those used in hallways may have the edging portion 32 along only the two long sides of the mat or no edging portion 32 at all.

FIG. 8 illustrates a cross-section of this edging portion 32. As illustrated, a preferred embodiment of the edging portion includes a bevelled portion 33 and a grooved portion 34 running the length of the edging portion 32. The bevelled portion 33 permits the edge of the mat 30 to drape more desirably over the floor and prevents tripping on the edge of the mat. The grooved portion 34 contains the skid-free upper surface 31 which is attached at 35 to the edging portion 32 by any suitable attachment means such as with commercially available adhesives.

FIG. 7 illustrates the edging portion 32 and upper surface 31 pulled away from the fiber-containing removable portion 37 below. This fiber-containing removable portion is as described previously, except that in the presently described embodiment, the fiber-containing removable portion is positioned below the upper surface, 31, next to the floor, rather than above a base. In the embodiment illustrated in FIGS. 6–8, the edging portion includes a base surface 38 to which is attached a self-gripping fastener means 36, previously described. The self-gripping fastener means 36 may alternatively or additionally be secured to the underside of the upper surface 31 as illustrated at 36*a*.

The edging portion 32 may be fabricated of any durable material, such as polyvinyl chloride or other materials known to those skilled in the art. As illustrated in FIG. 6, when the edging portion 32 circumvents the entire periphery of the skid-free perforated upper surface portion 31 it is desirable to join the corners 39 of the edging portion 32 with 45° joints.

The upper surface portion 31 may comprise a wide range of materials. Two types of materials have proven especially effective. The first is an open material such as a vinyl mesh or "spaghetti vinyl" material such as that manufactured by Interway, Incorporated of Shannon, Georgia, or a perforated mesh vinyl such as NOMAD, manufactured by the 3M Company of Minneapolis, Minnesota. Such material permits liquids to penetrate from the upper surface through to the fiber-containing removable portion 37 below, where such liquids may be absorbed or adsorbed.

A second type of upper surface is a non-open material such as the base portion 10 previously described. However, in the presently described embodiment, the base portion 10 becomes the upper surface 31 and is used to prevent liquids from seeping up from the fiber-containing removable portion positioned below.

Figure 9:
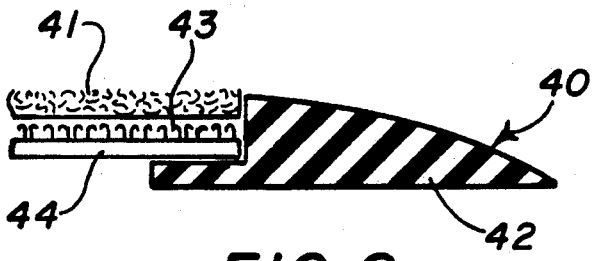
FIG. 9 is a view similar to FIG. 8 of a further embodiment of the present invention.
Figure 10:
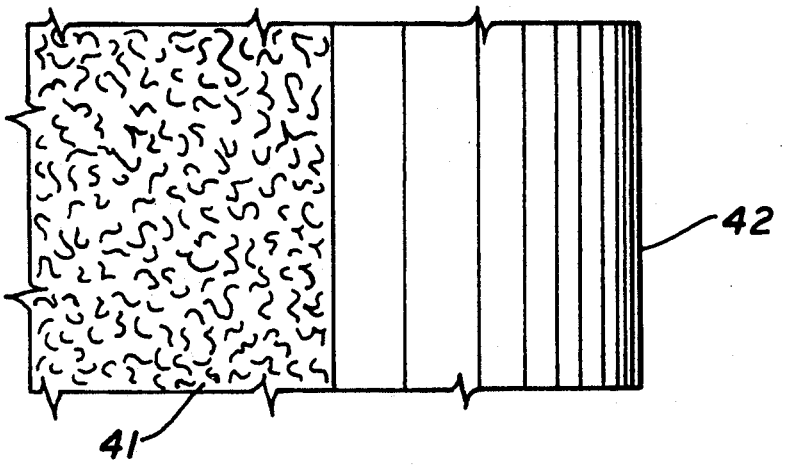
FIG. 10 is an overhead plan view of the floor system shown in FIG. 9.

Still another preferred embodiment of the invention is illustrated in FIGS. 9 and 10, wherein a section of a floor mat 40 is depicted with a fiber-containing removable portion 41 bounded by an edging portion 42, and is removably attached to self-gripping fastener means 43, which are attached to a base portion 44 beneath the fiber-containing removable portion 41. The base layer 44 may be fabricated with ribs (not shown) previously described, to further encourage welling liquid away from the fiber-containing removable portion 41 above.

Although the invention has been described in detail in the foregoing for the purpose of illustration, it is to be understood that such detail is solely for that purpose and that variations can be made therein by those skilled in the art without departing from the spirit and scope of the invention as stated in the claims.

I claim:

1. A floor mat for placement upon a base floor subject to unclean or wet environments, said mat comprising a fiber-containing removable portion removably attached to an upper surface portion and at least partially bounded by an edging portion, said fiber-containing removable portion being removably attached to said edging portion or said upper surface, said removable portion comprised of an absorbent material adapted for absorbing liquids and for permitting drainage of liquid therethrough, said upper surface portion adapted to reduce incidence of pedestrian skidding relative to base floor surface on which said mat is placed.

2. A floor mat as described in claim 1 wherein the fiber-containing removable portion is disposable.

3. A floor mat as described in claim 1 wherein the fiber-containing removable portion is reusable.

4. A floor mat as described in claim 1 wherein said fiber-containing removable portion includes fibers selected from the group of polyester, polypropylene or combinations thereof.

5. The floor mat of claim 1 wherein said upper surface portion is comprised of material selected from the group of polyvinyl chloride, natural rubber, synthetic rubber, polyethylene, polyurethane and acrylonitrile.

6. The floor mat of claim 5 wherein said upper surface portion comprises a perforated structure that permits liquids to run through to said removable portion.

7. The floor mat of claim 5 wherein said upper surface portion comprises a closed structure that prevents liquids from passing through from the removable portion.

8. The floor mat of claim 1 further comprising a self-gripping fastener means carried by said upper surface portion for enabling removable attachment of said removable portion, said self-gripping fastener means being hook and loop type fastener means, and wherein an upper surface of said removable portion is sufficiently rough to permit removable attachment to said hook and loop type fastener means.

* * * * *